US007641002B2

(12) United States Patent
Hall et al.

(10) Patent No.: US 7,641,002 B2
(45) Date of Patent: Jan. 5, 2010

(54) DRILL BIT

(76) Inventors: David R. Hall, 2185 S. Larsen Pkwy., Provo, UT (US) 84606; John Bailey, 2185 S. Larsen Pkwy., Provo, UT (US) 84606; Casey Webb, 2185 S. Larsen Pkwy., Provo, UT (US) 84606

( * ) Notice: Subject to any disclaimer, the term of this patent is extended or adjusted under 35 U.S.C. 154(b) by 152 days.

(21) Appl. No.: 12/057,597

(22) Filed: Mar. 28, 2008

(65) Prior Publication Data

US 2008/0173482 A1 Jul. 24, 2008

Related U.S. Application Data

(63) Continuation-in-part of application No. 12/039,608, filed on Feb. 28, 2008, which is a continuation-in-part of application No. 12/037,682, filed on Feb. 26, 2008, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 12/057,597, which is a continuation-in-part of application No. 11/555,334, filed on Nov. 1, 2006, now Pat. No. 7,419,018, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 10/26* (2006.01)
*E21B 10/54* (2006.01)

(52) U.S. Cl. ..... 175/385; 175/426

(58) Field of Classification Search ..... 175/385, 175/426

See application file for complete search history.

(56) References Cited

U.S. PATENT DOCUMENTS 465,103 A 12/1891 Wegner (Continued)

*Primary Examiner*—Hoang Dang
(74) *Attorney, Agent, or Firm*—Tyson J. Wilde

(57) ABSTRACT

In one aspect of the present invention, a rotary drag drill bit has a body intermediate a shank and a working face. The working face has a plurality of blades converging towards a center of the working face and diverging towards a gauge of the working face. A carbide section is fixed to the working face and positioned within a pocket disposed within an inverted cone of the working face. The carbide section has a distal end exposed within the working face.

18 Claims, 8 Drawing Sheets

U.S. PATENT DOCUMENTS

| | | | |
|---|---|---|---|
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 6/1921 | Midgett |
| 1,460,671 | A | 7/1923 | Hebsacker |
| 1,544,757 | A | 7/1925 | Hufford |
| 1,821,474 | A | 9/1931 | Mercer |
| 1,879,117 | A | 9/1932 | Gault |
| 2,054,255 | A | 9/1936 | Howard |
| 2,064,255 | A | 12/1936 | Garfield |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,294,186 | A | 12/1966 | Buell |
| 3,301,339 | A | 1/1967 | Pennebaker |
| 3,379,264 | A | 4/1968 | Cox |
| 3,429,390 | A | 2/1969 | Bennett |
| 3,493,165 | A | 2/1970 | Schonfield |
| 3,583,504 | A | 6/1971 | Aatund |
| 3,764,493 | A | 10/1973 | Rosar |
| 3,821,993 | A | 7/1974 | Kniff |
| 3,955,635 | A | 5/1976 | Skidmore |
| 3,960,223 | A | 6/1976 | Kleine |
| 4,081,042 | A | 3/1978 | Johnson |
| 4,096,917 | A | 6/1978 | Harris |
| 4,106,577 | A | 8/1978 | Summers |
| 4,176,723 | A | 12/1979 | Arceneaux |
| 4,253,533 | A | 3/1981 | Baker |
| 4,280,573 | A | 7/1981 | Sudnishnikov |
| 4,304,312 | A | 12/1981 | Larsson |
| 4,307,786 | A | 12/1981 | Evans |
| 4,397,361 | A | 8/1983 | Langford |
| 4,416,339 | A | 11/1983 | Baker |
| 4,445,580 | A | 5/1984 | Sahley |
| 4,448,269 | A | 5/1984 | Ishikawa |
| 4,499,795 | A | 2/1985 | Radtke |
| 4,531,592 | A | 7/1985 | Hayatdavoudi |
| 4,535,853 | A | 8/1985 | Ippolito |
| 4,538,691 | A | 9/1985 | Dennis |
| 4,566,545 | A | 1/1986 | Story |
| 4,574,895 | A | 3/1986 | Dolezal |
| 4,640,374 | A | 2/1987 | Dennis |
| 4,852,672 | A | 8/1989 | Behrens |
| 4,889,017 | A | 12/1989 | Fuller |
| 4,962,822 | A | 10/1990 | Pascale |
| 4,981,184 | A | 1/1991 | Knowlton |
| 5,009,273 | A | 4/1991 | Grabinski |
| 5,027,914 | A | 7/1991 | Wilson |
| 5,038,873 | A | 8/1991 | Jurgens |
| 5,119,892 | A | 6/1992 | Clegg |
| 5,141,063 | A | 8/1992 | Quesenbury |
| 5,186,268 | A | 2/1993 | Clegg |
| 5,222,566 | A | 6/1993 | Taylor |
| 5,255,749 | A | 10/1993 | Bumpurs |
| 5,265,682 | A | 11/1993 | Russell |
| 5,361,859 | A | 11/1994 | Tibbitts |
| 5,410,303 | A | 4/1995 | Comeau |
| 5,417,292 | A | 5/1995 | Polakoff |
| 5,423,389 | A | 6/1995 | Warren |
| 5,507,357 | A | 4/1996 | Hult |
| 5,560,440 | A | 10/1996 | Tibbitts |
| 5,568,838 | A | 10/1996 | Struthers |
| 5,655,614 | A | 8/1997 | Azar |
| 5,678,644 | A | 10/1997 | Fielder |
| 5,732,784 | A | 3/1998 | Nelson |
| 5,794,728 | A | 8/1998 | Palmberg |
| 5,896,938 | A | 4/1999 | Moeny |
| 5,947,215 | A | 9/1999 | Lundell |
| 5,950,743 | A | 9/1999 | Cox |
| 5,957,223 | A | 9/1999 | Doster |
| 5,957,225 | A | 9/1999 | Sinor |
| 5,967,247 | A | 10/1999 | Pessier |
| 5,979,571 | A | 11/1999 | Scott |
| 5,992,547 | A | 11/1999 | Caraway |
| 5,992,548 | A | 11/1999 | Silva |
| 6,021,859 | A | 2/2000 | Tibbitts |
| 6,039,131 | A | 3/2000 | Beaton |
| 6,131,675 | A | 10/2000 | Anderson |
| 6,150,822 | A | 11/2000 | Hong |
| 6,186,251 | B1 | 2/2001 | Butcher |
| 6,202,761 | B1 | 3/2001 | Forney |
| 6,213,226 | B1 | 4/2001 | Eppink |
| 6,223,824 | B1 | 5/2001 | Moyes |
| 6,269,893 | B1 | 8/2001 | Beaton |
| 6,296,069 | B1 | 10/2001 | Lamine |
| 6,340,064 | B2 | 1/2002 | Fielder |
| 6,364,034 | B1 | 4/2002 | Schoeffler |
| 6,394,200 | B1 | 5/2002 | Watson |
| 6,439,326 | B1 | 8/2002 | Huang |
| 6,474,425 | B1 | 11/2002 | Truax |
| 6,484,825 | B2 | 11/2002 | Watson |
| 6,510,906 | B1 | 1/2003 | Richert |
| 6,513,606 | B1 | 2/2003 | Krueger |
| 6,533,050 | B2 | 3/2003 | Molloy |
| 6,594,881 | B2 | 7/2003 | Tibbitts |
| 6,601,454 | B1 | 8/2003 | Botnan |
| 6,622,803 | B2 | 9/2003 | Harvey |
| 6,668,949 | B1 | 12/2003 | Rives |
| 6,729,420 | B2 | 5/2004 | Mensa-Wilmot |
| 6,732,817 | B2 | 5/2004 | Dewey |
| 6,822,579 | B2 | 11/2004 | Goswami |
| 6,929,076 | B2 | 8/2005 | Fanuel |
| 6,953,096 | B2 | 10/2005 | Gledhill |
| 2003/0213621 | A1 | 11/2003 | Britten |
| 2004/0238221 | A1 | 12/2004 | Runia |
| 2004/0256155 | A1 | 12/2004 | Kriesels |

DRILL BIT

CROSS REFERENCE TO RELATED APPLICATIONS

This Patent Application is a continuation-in-part of U.S. patent application Ser. No. 12/039,608 filed Feb. 28, 2008 which is a continuation-in-part of U.S. patent application Ser. No. 12/037,682 filed Feb. 26, 2008 which a continuation-in-part of U.S. patent application Ser. No. 12/019,782 filed Jan. 25, 2008 now U.S. Pat. No. 7,617,886 which is a continuation-in-part of U.S. patent application Ser. No. 11/837,321 filed Aug. 10, 2007 now U.S. Pat. No. 7,559,379 which is a continuation-in-part of U.S. patent application Ser. No. 11/750,700filed May 18, 2007 now U.S. Pat. No. 7,559,489. U.S. patent application Ser. No. 11/750,700 is a continuation-in-part of U.S. patent application Ser. No. 11/737,034 filed Apr. 18, 2007 now U.S. Pat. No. 7,503,405 U.S. patent application Ser. No. 11/737,034 is a continuation-in-part of U.S. patent application Ser. No. 11/686,638 filed Mar. 15, 2007 now U.S. Pat. No. 7,503,405. U.S. patent application Ser. No. 11/686,638 is a continuation-in-part of U.S. patent application Ser. No. 11/680,997 filed Mar. 1, 2007 now U.S Pat. No. 7,419,016. U.S. patent application Ser. No. 11/680,997 is a continuation-in-part of U.S. patent application Ser. No. 11/673,872 filed Feb. 12, 2007 now U.S. Pat. No. 7,484,576. U.S. patent application Ser. No. 11/673,872 is a continuation-in-part of U.S. patent application Ser. No. 11/611,310 filed Dec. 15, 2006 now U.S. Pat. No. 7,600,586. This Patent Application is also a continuation-in-part of U.S. patent application Ser. No. 11/278,935 filed Apr. 6, 2006 now U.S. Pat. No. 7,426,968. U.S. patent application Ser. No. 11/278,935 is a continuation-in-part of U.S. patent application Ser. No. 11/277,394 filed Mar. 24, 2006 now U.S. Pat. No. 7,398,837. U.S. patent application Ser. No. 11/277,394 is a continuation-in-part of U.S. patent application Ser. No. 11/277,380. U.S. patent application Ser. No. 11/277,380 filed Mar. 24, 2006 now U.S. Pat. No. 7,337,858 is a continuation-in-part of U.S. patent application Ser. No. 11/306,976 filed Jan. 18, 2006 now U.S. Pat. No. 7,360,610. U.S. patent application Ser. No. 11/306,976 is a continuation-in-part of 11/306,307 filed Dec. 22, 2005 now U.S. Pat. No. 7,225,886. U.S. patent application Ser. No. 11/306,307 is a continuation-in-part of U.S. patent application Ser. No. 11/306,022 filed Dec. 14, 2005 now U.S Pat. No. 7,270,196. U.S. patent application Ser. No. 11/306,022 is a continuation-in-part of U.S. patent application Ser. No. 11/164,391 filed Nov. 21, 2005. This application is also a continuation-in-part of U.S. patent application Ser. No. 11/555,334 which was filed on Nov. 1, 2006. All of these applications are herein incorporated by reference in their entirety.

BACKGROUND OF THE INVENTION

This invention relates to drill bits, specifically drill bit assemblies for use in oil, gas, geothermal, and horizontal drilling. More specifically, the invention relates to the shear bits having a high drilling efficiency while providing bit stability downhole during a drilling operation. The invention also relates to drill bits having elements that help to reduce wear while drilling, thereby extending the life of the bit.

U.S. Patent Publication US20030213621 to Britten et al. which is herein incorporated by reference for all that it contains, discloses a guide assembly for a core drill bit, which is at least partially guided at an inner wall of the core drill bit and projects radially with projections between the plurality of cutting inserts arranged on a frontal surface of the drill tube of the core drill bit, wherein a centering means projects at least axially, in part, beyond the cutting inserts, whereby the centering means is shorter than the axial length of the drill tube, and is axially spring-biased inside the guide assembly and has limited axial displacement.

U.S. Pat. No. 6,296,069 to Lamine et al., which is herein incorporated by reference for all that it contains, discloses a drill bit as used in particular in the oil well drilling field comprising a central body, cutting blades protruding with respect to the body, both at the front of this body according to a drill direction and at the sides of this same body, and cutting elements divided over an outer front surface and over an outer lateral well sizing surface comprised by each blade, wherein there are provided as cutting elements: in a central area of the front surface, on at least one blade: at least one synthetic polycrystalline diamond compact cutting disc, and in a remaining area of the front surface of this blade, situated beyond said central area with respect to the rotation axis, and on the other blades: thermally stable synthetic diamonds and/or impregnated diamond particles.

U.S. Pat. No. 5,244,039 to Newton, Jr. et al., which is herein incorporated by reference for all that it contains, discloses a rotary drill bit for drilling holes in subsurface formations comprising a bit body having a shank for connection to a drill string, a plurality of perform primary cutting elements mounted on the bit body and defining a primary cutting profile having a downwardly convex nose portion. There are associated with at least certain of the primary cutting elements respective secondary elements which are spaced inwardly of the primary profile. The distance of the secondary elements from the primary profile, when measured in direction perpendicular to said profile, is generally greater for secondary elements nearer the nose portion than it is for secondary elements further away from the nose portion, and is preferably such that the vertical distance of the secondary elements from the profile is substantially constant.

BRIEF SUMMARY OF THE INVENTION

In one aspect of the present invention, a rotary drag drill bit has a body intermediate a shank and a working face. The working face has a plurality of blades converging towards a center of the working face and diverging towards a gauge of the working face. A carbide section is fixed to the working face and positioned within a pocket disposed within an inverted cone of the working face. The carbide section has a distal end exposed within the working face.

At least one cutting element may be brazed to a distal portion of the carbide section. The carbide section may be brazed or shrink fit within the pocket formed in the working face. In some embodiments, the drill bit body may be made of steel. In other embodiments, the bit body may be made of matrix. A steel sleeve may be intermediate the carbide section and a wall of the pocket. The carbide section may also form a portion of a cone section of at least one blade of the plurality of blades, the at least one blade having a slope transition formed by the cone section of the blade and the carbide section. The carbide section of the blade may have a larger cone angle than the cone section of the blade. A portion of the carbide section may protrude from the working face. The protruding portion of the carbide section may comprise a length of 0.25 to 2 inches. In other embodiments, the carbide section may be disposed about a jack element coaxial with an axis of rotation of the drill bit, the jack element extending out of an opening formed in the working face. A nozzle may be disposed within a portion of the carbide section. In some embodiments, the carbide section may taper to a point.

In another aspect of the present invention, a rotary drag drill bit has a body intermediate a shank and a working face. The working face has a plurality of blades converging towards a center of the working face and diverging towards a gauge of the working face. A cone portion of at least one blade of the plurality of blades has a slope transition formed by at least two contiguous substantially flat sections with different cone angles. A radially proximal flat section has a smaller cone angle than a radially distal flat section.

A plurality of cutting elements may be arrayed along any portion of the at least one blade including the cone portion, nose portion, flank portion, gauge portion, or combinations thereof. The radially proximal cone angle may comprise an angle between 30 and 60 degrees with respect to a horizontal plane of the working face. The radially distal cone angle may comprise an angle between 5 and 25 degrees with respect to a horizontal plane of the working face. It is believed that shallow cone angles allow for quicker drilling while sharper cone angles stabilize the drill bit during a drilling operation.

A jack element may protrude beyond the nose portion of the at least one blade. A bushing may be disposed about the jack element, the bushing being adapted to support the jack element.

DETAILED DESCRIPTION OF THE INVENTION AND THE PREFERRED EMBODIMENT

Figure 1:
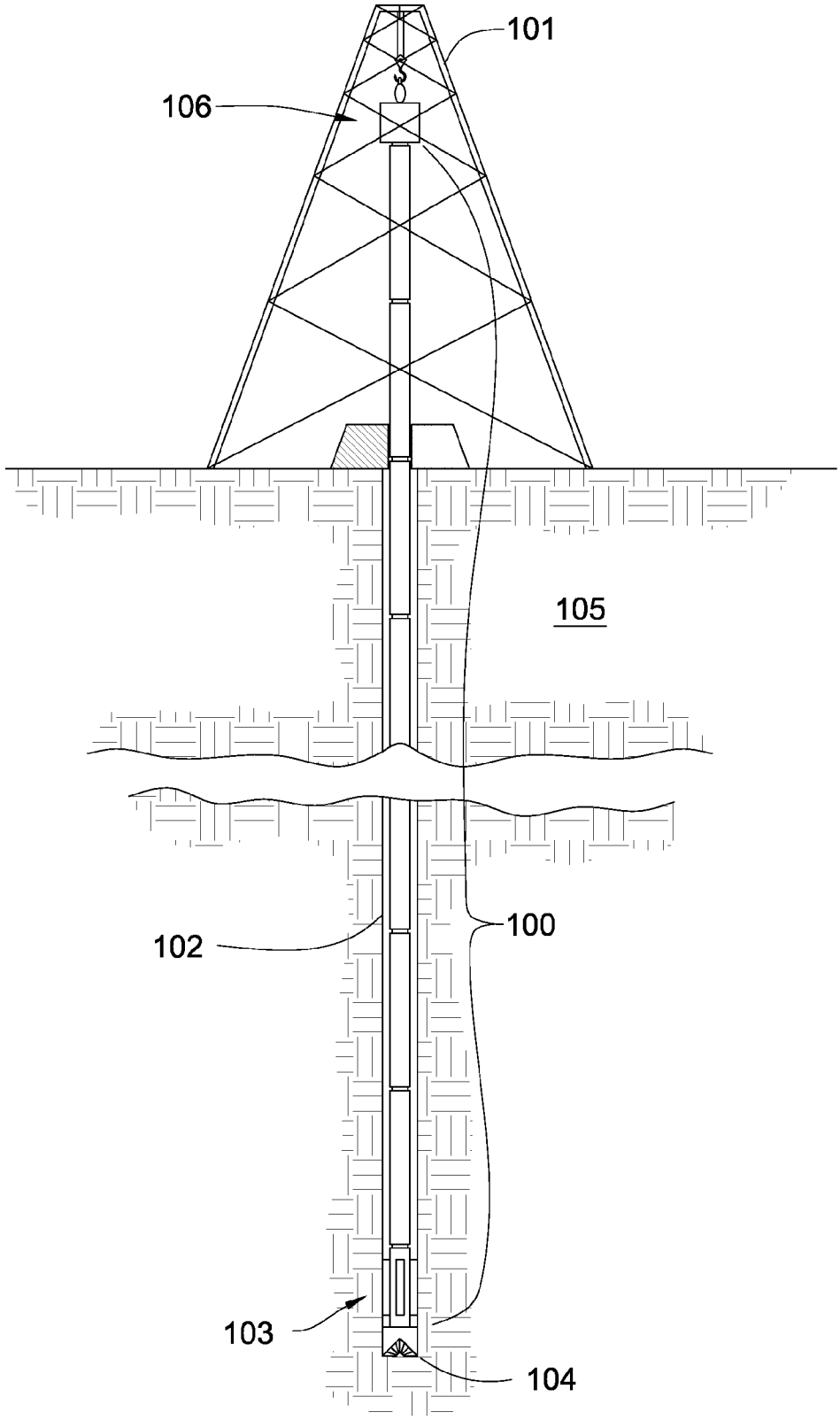
FIG. 1 is a perspective diagram of an embodiment of a tool string suspended in a borehole.

FIG. 1 is a perspective diagram of an embodiment of a tool string 100 suspended by a derrick 101 in a borehole 102. A bottom-hole assembly 103 is located at the bottom of the borehole 102 and comprises a drill bit 104. As the drill bit 104 rotates downhole the tool string 100 advances farther into the earth. The tool string 100 may penetrate soft or hard subterranean formations 105. The bottom-hole assembly 103 and/or downhole components may comprise data acquisition devices which may gather data. The data may be sent to the surface via a transmission system to a data swivel 106. The data swivel 106 may sent the data to the surface equipment. Further, the surface equipment may send data and/or power to downhole tools and/or the bottom hole assembly 103. U.S. Pat. No. 6,670,880 which is herein incorporated by reference for all that it contains, discloses a telemetry system that may be compatible with the present invention; however, other forms of telemetry system that may be compatible with the present invention; however, other forms of telemetry may also be compatible such as systems that include mud pulse systems, electromagnetic waves, radio waves, wire pipe, and/or short hop. In some embodiments, no telemetry system is incorporated into the tool string.

Figure 2:
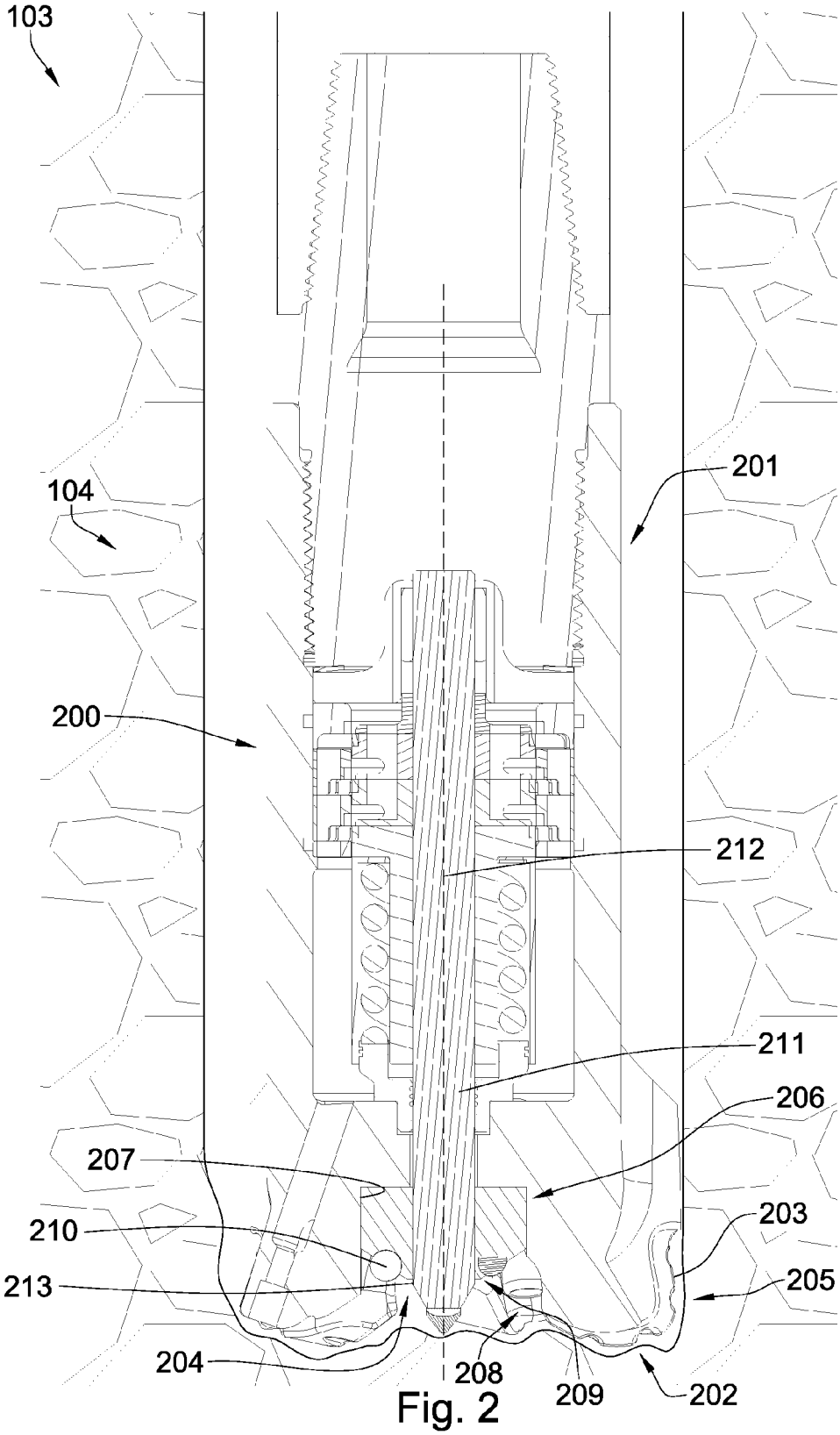
FIG. 2 is a cross-section diagram of an embodiment of a bottom-hole assembly.

FIG. 2 illustrates a cross-sectional diagram of an embodiment of a bottom-hole assembly 103. The drilling assembly comprises a rotary drag drill bit 104; the drill bit having a body 200 intermediate a shank 201 and a working face 202. The working face 202 has a plurality of blades 203 converging toward a center 204 of the working face and diverging toward a gauge 205 of the working face. A carbide section 206 is fixed to the working face 202 and positioned within a pocket 207 within an inverted cone 208 of the working face. The carbide section 206 has a distal end 209 exposed within the working face 202. At least one cutting element 210 may be brazed to the distal end 209 of the carbide section 206. It is believed that the at least on cutting element 210 brazed to the carbide section 206 may help to break up the formation 105 being drilled nearest the center of the working face 202. The carbide section 206 may be brazed within the pocket 207 or may be shrink-fit within the pocket. In some embodiments, the drill bit body 200 may be made of steel, whereas in other embodiments, the drill bit body may be made of matrix. In the preferred embodiment, the carbide section 206 may be disposed about a jack element 211 coaxial with an axis of rotation 212 of the drill bit 104, the jack element 211 extending out of an opening 213 formed in the working face 202.

Figure 3:
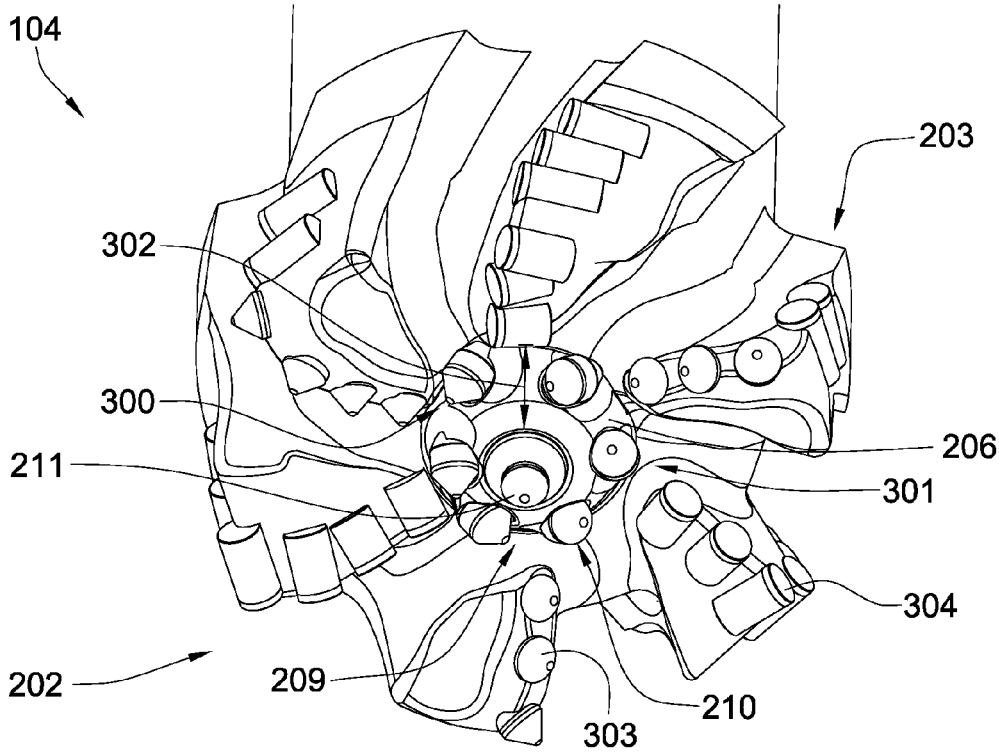
FIG. 3 is a perspective diagram of an embodiment of a rotary drag drill bit.

Now referring to FIG. 3, the drill bit 104 may have a carbide section 206, the carbide section having at least one cutting element 210 brazed to the distal end 209 of the carbide section. It is believed that having a carbide section will help to reduce wear on the bit face and other surrounding elements of the bit. The carbide section 206 may comprise a substantially cylindrical geometry. In this embodiment, a plurality of cutting elements 210 may be brazed to the carbide section 206, the cutting elements comprising a pointed geometry 300. The cutting elements disposed on the carbide section may help to break up the formation being drilled proximal the center of the working face, and thereby increase the efficiency of the drilling operation. A portion 301 of the carbide section 206 may protrude from the working face 202. In this embodiment, the protruding portion 301 may comprise a length 302 of 0.25 to 2 inches. Also in this embodiment, a jack element 211 may extend from the center of the carbide section 206. A plurality of cutting elements may also be disposed on the plurality of blades 203 of the drill bit 104. Some blades may comprise pointed cutting elements 303 while others comprise shear cutting elements 304. The carbide section 206 may be disposed about a jack element 211 extending from the working face 202. The carbide section 206 may be a bushing adapted to support the jack element 211.

Figure 4:
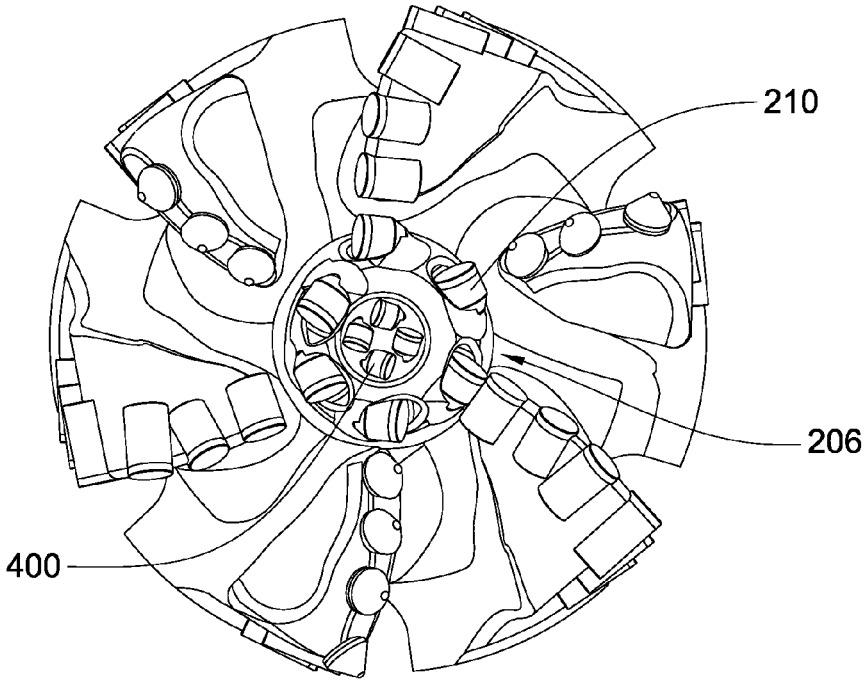
FIG. 4 is a perspective diagram of another embodiment of a rotary drag drill bit.

In the embodiment of FIG. 4, the plurality of cutting elements 210 disposed on the carbide section 206 may be shear cutting elements. In this embodiment, the carbide section 206 may comprise a substantially cylindrical geometry. The distal end 209 of the carbide section 206 may comprise a substantially flat geometry having at least one shear cutting element disposed thereon. The carbide substrate 206 may also have an inner row of cutting elements 400 disposed near the center of the distal end 209 of the carbide section.

Figure 5:
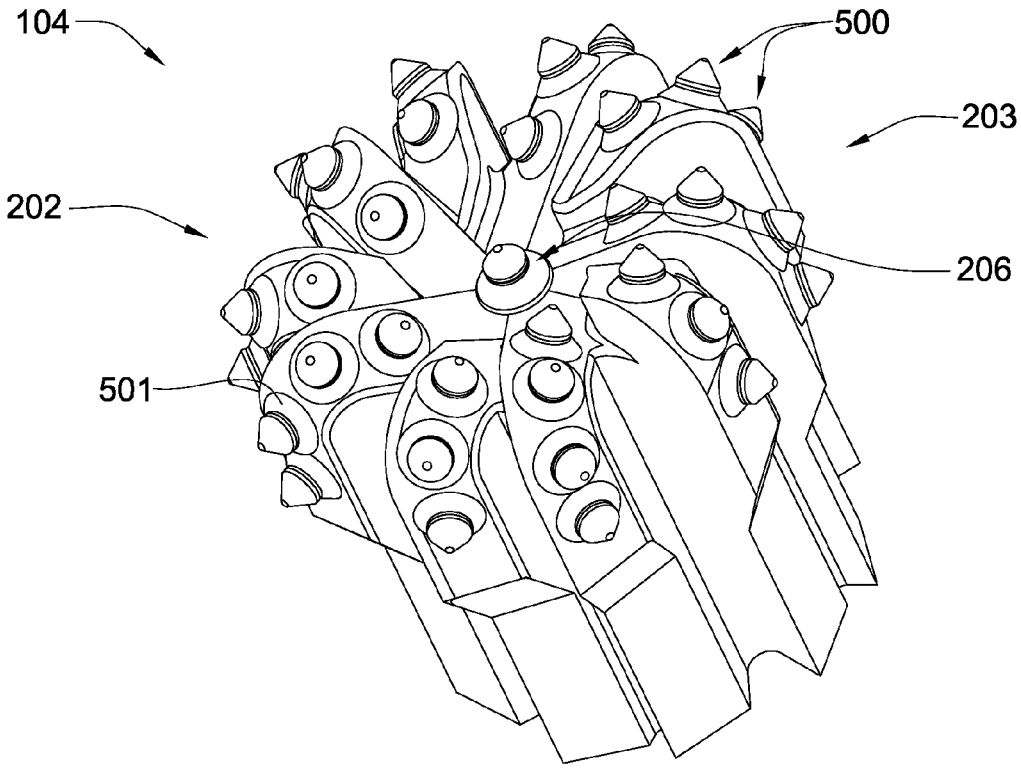
FIG. 5 is a perspective diagram of another embodiment of a rotary drag drill bit.
Figure 6:
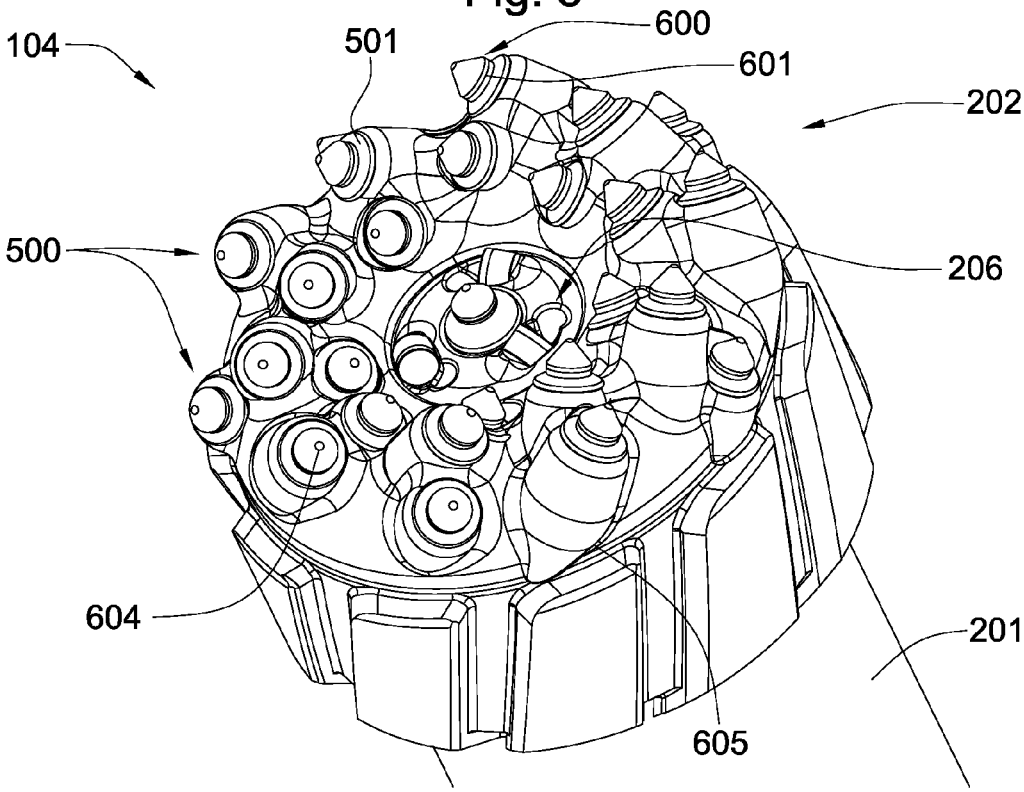
FIG. 6 is a perspective diagram of another embodiment of a rotary drag drill bit.

FIGS. 5 and 6 disclose two embodiments of a drill bit 104 having at least one cutting element; the cutting element being a degradation assembly 500. FIG. 5 discloses a rotary drag bit 104 having 10 blades 203 formed in the working face 202 of the drill bit 104. The carbide section 206 may extend from the working face 202. The at least one degradation assembly 500 may be disposed within a carbide extension 501; the carbide extension extending from the working face 202 and forming a portion of the plurality of blades 206. Referring now to FIG. 6, the plurality of blades may be formed by the degradation assemblies 500 in the working face 202 of the drill bit 104. The drill bit 104 may also comprise degradation assemblies 500 of varying sizes. The degradation assembly 500 comprises a working portion 600 and a shank assembly 601. The working portion 600 may comprise an impact tip 604 that is brazed to the cemented metal carbide extension 501. The carbide extension 501 may be adapted to interlock with the shank assembly 601. The shank assembly 601 may be adapted to fit into a cavity 605 formed in a base end 606 of the carbide extension 501. In this embodiment, at least one cutting element may also be disposed on the carbide section 206.

Figure 7:
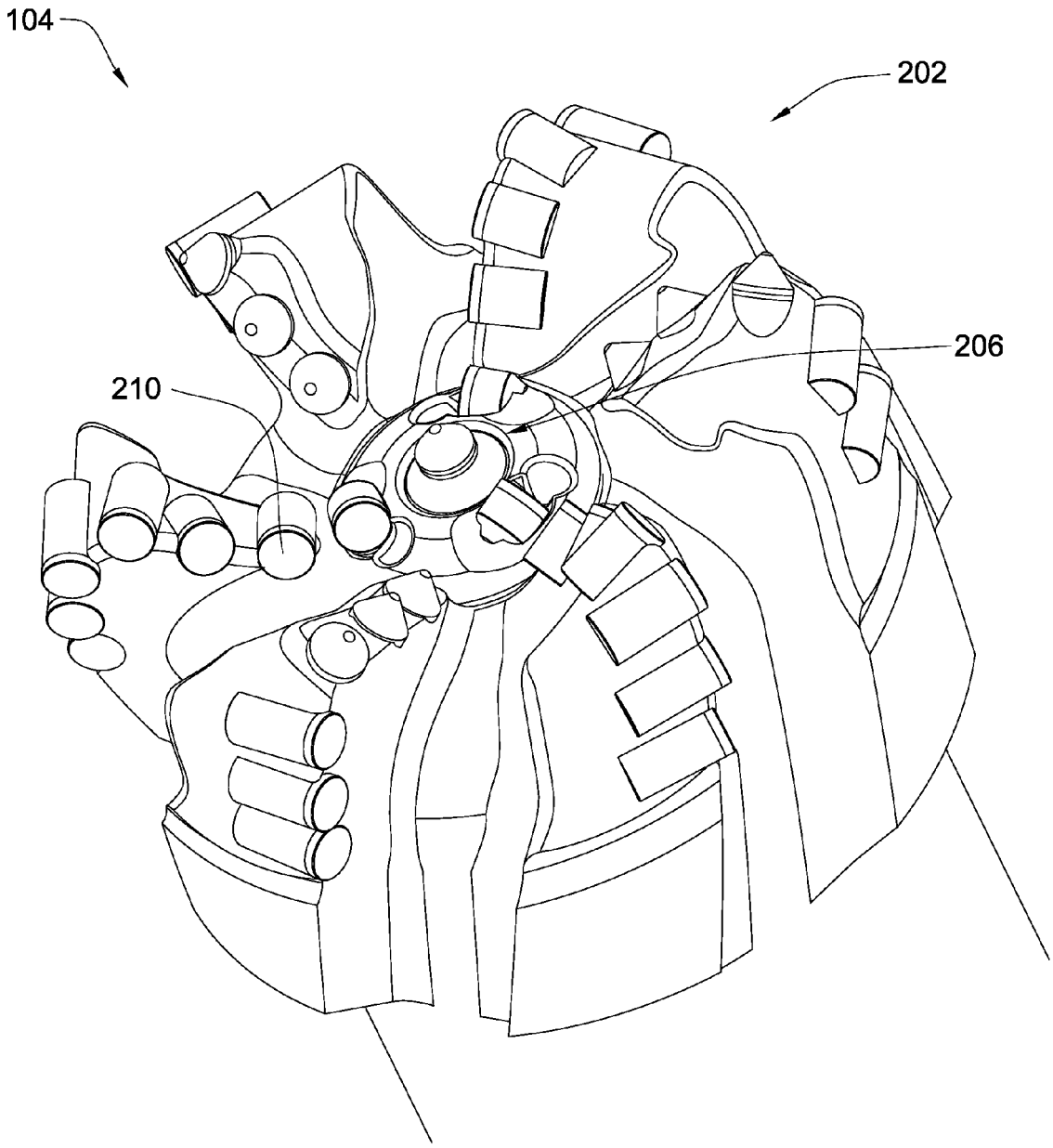
FIG. 7 is a perspective diagram of another embodiment of a rotary drag drill bit.

FIG. 7 shows an embodiment of a drill bit 104 having a carbide section 206 set back into the working face 202. A plurality of cutting elements 210 may be disposed on the carbide section 206; the cutting elements 210 being adapted to break up the formation being drilled nearest the carbide section 206.

Figure 8:
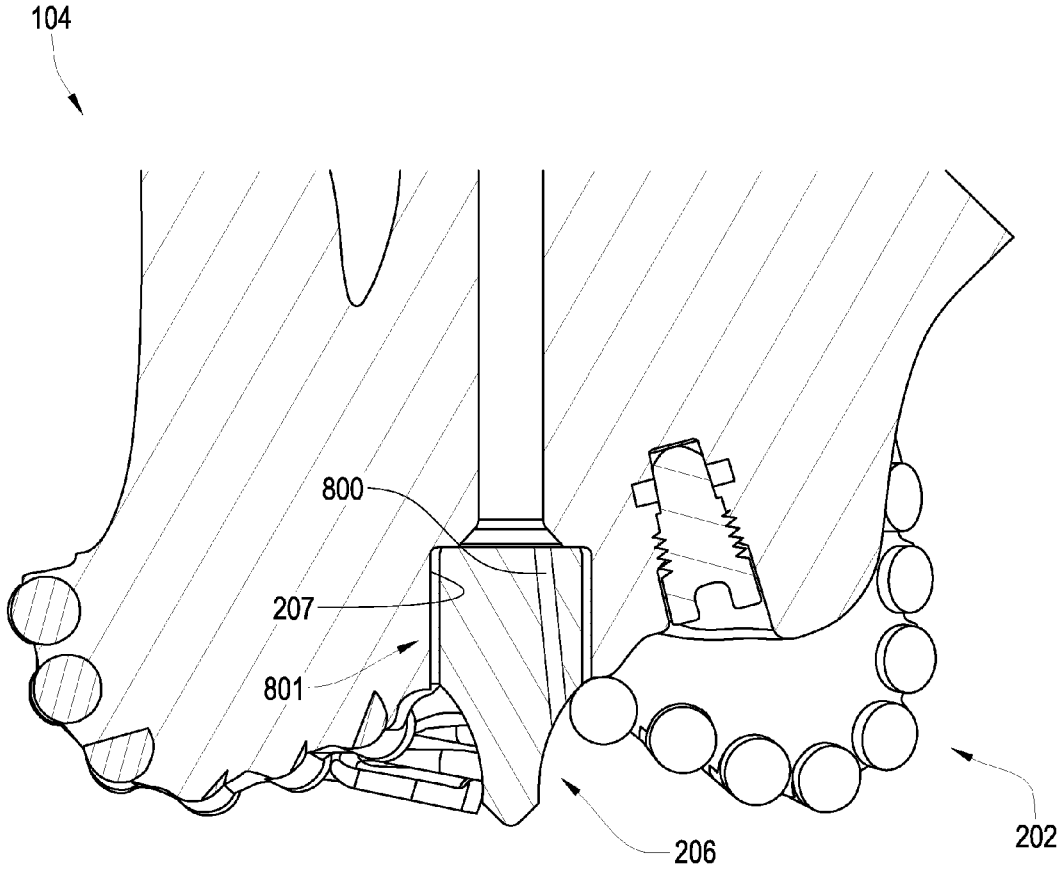
FIG. 8 is a perspective diagram of another embodiment of a rotary drag drill bit.

FIG. 8 illustrates a portion of the carbide section 206 protruding from the working face 202. At least one nozzle 800 may be disposed within a portion of the carbide section 206. The carbide section 206 may taper to a point. A steel sleeve 801 may be disposed intermediate the carbide section and a wall of the pocket 207 of the drill bit 104. This may be beneficial in a matrix bit such that the steel prevents wear on the matrix bit from the carbide center.

Figure 9:
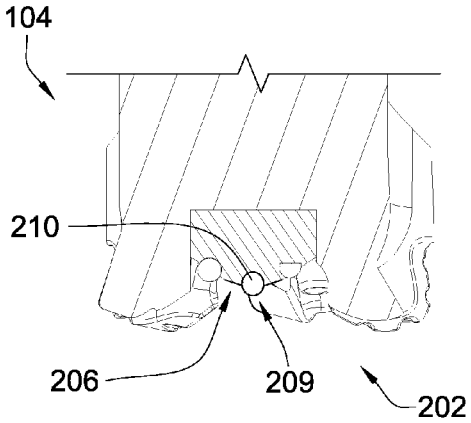
FIG. 9 is a cross-section diagram of another embodiment of a rotary drag drill bit.
Figure 10:
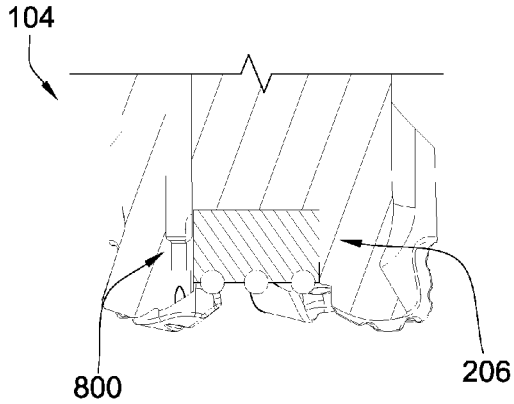
FIG. 10 is a cross-section diagram of another embodiment of a rotary drag drill bit.
Figure 11:
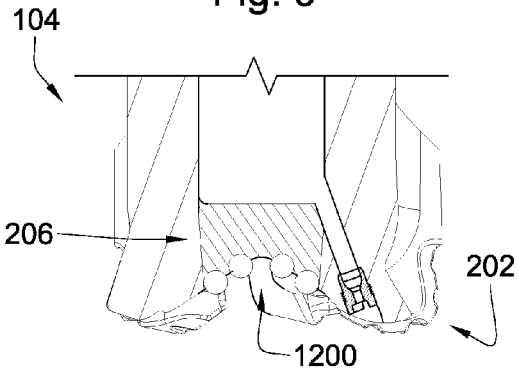
FIG. 11 is a cross-section diagram of another embodiment of a rotary drag drill bit.
Figure 12:
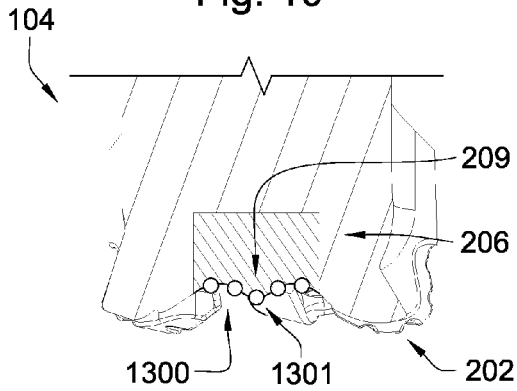
FIG. 12 is a cross-section diagram of another embodiment of a rotary drag drill bit.
Figure 13:
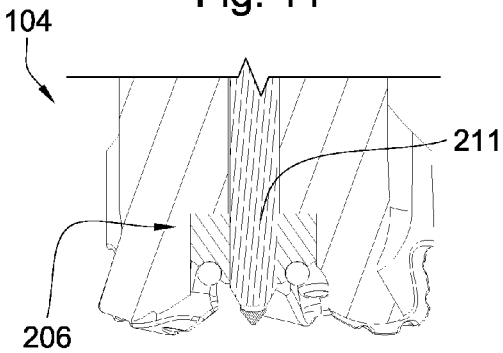
FIG. 13 is a cross-section diagram of another embodiment of a rotary drag drill bit.

FIGS. 9 through 16 illustrate embodiments of various drill bits 104. FIG. 9 shows a carbide insert 206 having a pointed distal end 209 protruding from the working face 202 of the drill bit 104; a cutting element 210 may be bonded to a portion of the distal end 209. FIG. 10 shows a carbide insert having a generally rectangular geometry. A nozzle 800 may be disposed within a portion of the carbide section 206. FIG. 11 illustrates a carbide insert 206 having a central portion 1200 set back into the working face 202. FIG. 11 also shows that central portion inserted from the bore of the drill bit. FIG. 12 illustrates the carbide section 206 having a concave portion 1300 and a convex portion 1301 proximal the distal end 209, the convex portion 1301 protruding from the working 202 face and the concave portion 1300 recessing in the working face 202. FIG. 13 illustrates the carbide section 206 being disposed about a jack element 211. The carbide section 206 may be a bushing adapted to support the jack element 211.

Figure 14:
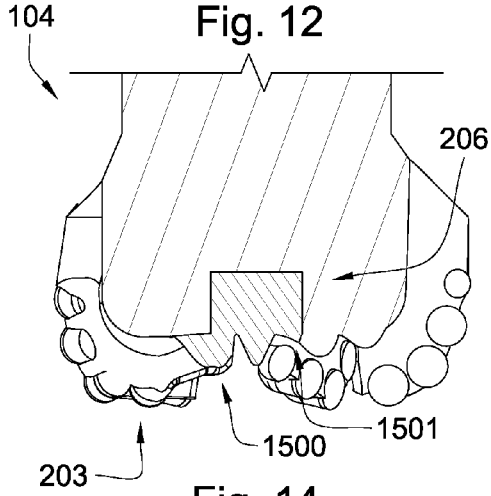
FIG. 14 is a cross-section diagram of another embodiment of a rotary drag drill bit.

Referring now to FIG. 14, the carbide section 206 may form a portion of a cone section 1500 of at least one blade 203 of the plurality of blades. The at least one blade 203 may comprise a slope transition 1501 formed by the cone section 1500 of the blade and the carbide section 206. The carbide section 206 may comprise a larger cone angle than the cone section of the blade 203.

Figure 15:
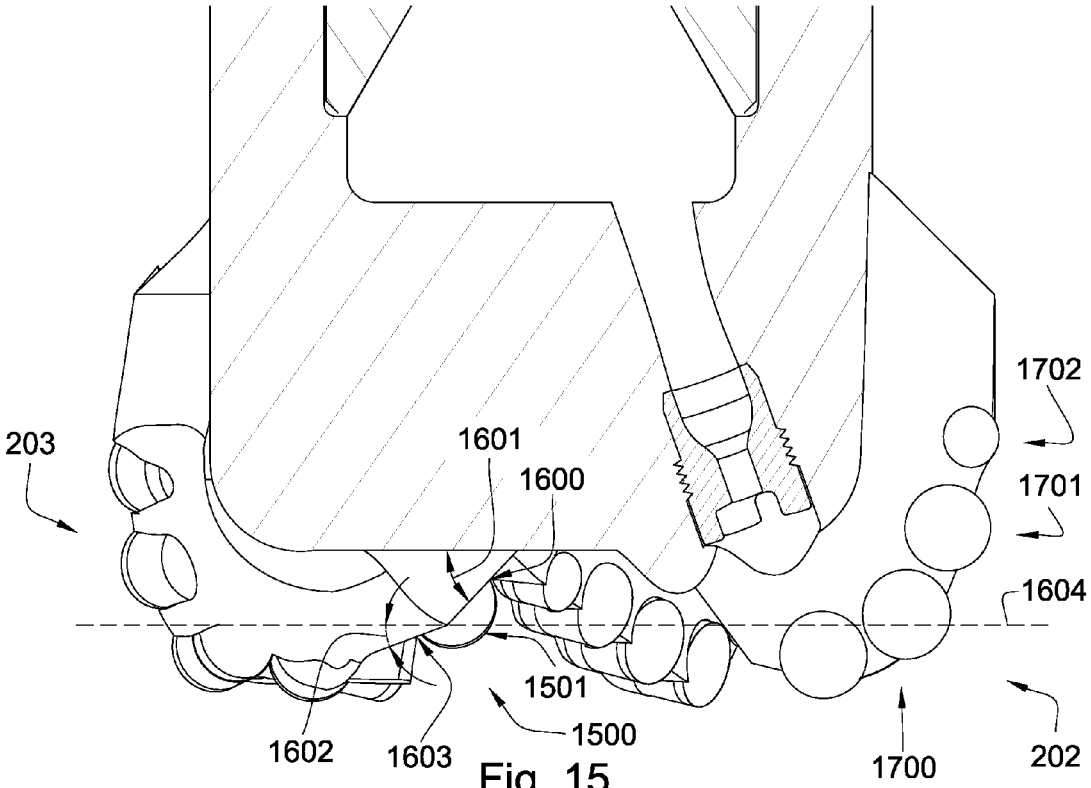
FIG. 15 is a cross-section diagram of another embodiment of a rotary drag drill bit.
Figure 16:
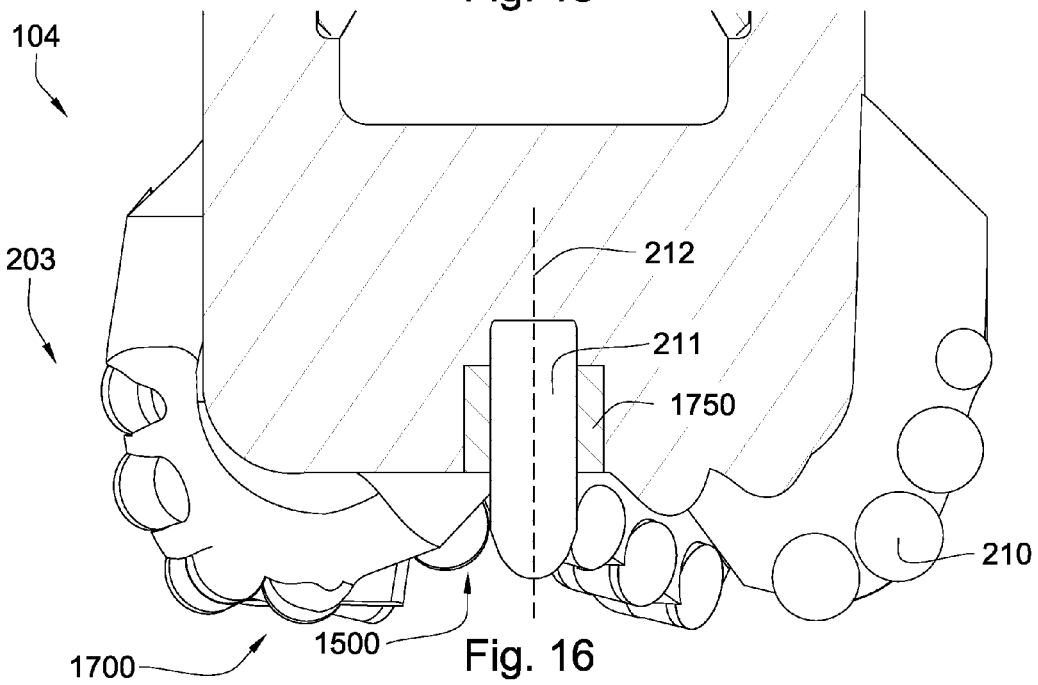
FIG. 16 is a cross-section diagram of another embodiment of a rotary drag drill bit.

Referring now to FIG. 15, a cone portion 1500 of at least one blade of the plurality of blades 203 has a slope transition 1501 formed by at least two contiguous substantially flat sections with different cone angles. A radially proximal flat section 1600 has a larger cone angle 1601 than a cone angle 1602 of a radially distal flat section 1603. In this embodiment, a plurality of cutting elements 210 may be arrayed along any portion of the at least one blade 203 including the cone portion 1500, nose portion 1700, flank portion 1701, gauge portion 1702, or combinations thereof. The radially proximal cone angle 1601 may comprise an angle between 30 and 60 degrees with respect to a horizontal plane 1604 of the working face 202 while the radially distal cone angle 1602 may comprise an angle between 5 and 25 degrees with respect to the horizontal plane 1604 of the working face 202. Referring now to FIG. 16, a jack element 211 coaxial with an axis of rotation 212 of the drill bit 104 may extend from an opening formed within the working face 202. The jack element 211 may protrude beyond the nose portion 1700 of the at least one blade 203. In this embodiment, a carbide bushing 1750 may be disposed about the jack element 211 within the working face 202.

Whereas the present invention has been described in particular relation to the drawings attached hereto, it should be understood that other and further modifications apart from those shown or suggested herein, may be made within the scope and spirit of the present invention.

What is claimed is:

1. A rotary drag drill bit, comprising:

a body intermediate a shank and a working face;

the working face comprising a plurality of blades converging toward a center of the working face and diverging toward a gauge of the working face;

a carbide section fixed to the working face and positioned within a pocket disposed within an inverted cone of the working face; and the carbide section comprising a distal end exposed within the working face;

wherein the carbide section is disposed about a jack element coaxial with an axis of rotation of the drill bit, the jack element extending out of an opening formed in the working face.

2. The drill bit of claim 1, wherein at least one cutting element is brazed to a distal portion of the carbide section.

3. The drill bit of claim 1, wherein the carbide section is brazed or shrink-fit within the pocket formed in the working face.

4. The drill bit of claim 1, wherein the drill bit body is made of steel.

5. The drill bit of claim 1, wherein the drill bit body is made of matrix.

6. The drill bit of claim 1, wherein a steel sleeve is intermediate the carbide section and a wall of the pocket.

7. The drill bit of claim 1, wherein the carbide section forms a portion of a cone section of at least one blade of the plurality of blades.

8. The drill bit of claim 7, the at least one blade comprises a slope transition formed by the cone section of the blade and the carbide section.

9. The drill bit of claim 8, wherein the carbide section comprises a larger cone angle than the cone section of the blade.

10. The drill bit of claim 1, wherein a portion of the carbide section protrudes from the working face.

11. The drill bit of claim 10, wherein the protruding portion of the carbide section comprises a length of 0.25 to 2 inches.

12. The drill bit of claim 1, wherein a portion of the carbide section is set back into the working face.

13. The drill bit of claim 1, wherein at least one nozzle is disposed within a portion of the carbide section.

14. The drill bit of claim 1, wherein carbide section tapers to a point.

15. The drill bit of claim 1, wherein the inverted cone is formed by the plurality of blades and comprises a slope transition formed by at least two contiguous substantially flat sections with different cone angles; and a radially proximal flat section comprising a larger cone angle than a radially distal flat section.

16. The drill bit of claim 15, wherein a plurality of cutting elements is arrayed along any portion of the at least one blade including the cone portion, nose portion, flank portion, gauge portion, or combinations thereof.

17. The drill bit of claim 15, wherein the radially proximal cone angle comprises an angle between 30 and 60 degrees with respect to a horizontal plane of the working face.

18. The drill bit of claim 15, wherein the radially distal cone angle comprises an angle between 5 and 25 degrees with respect to a horizontal plane of the working face.

* * * * *

UNITED STATES PATENT AND TRADEMARK OFFICE

CERTIFICATE OF CORRECTION

PATENT NO. : 7,641,002 B2
APPLICATION NO. : 12/057597
DATED : January 5, 2010
INVENTOR(S) : David R. Hall et al.

It is certified that error appears in the above-identified patent and that said Letters Patent is hereby corrected as shown below:

On the Title Page, Item (56)

Page 2, left column, line 11, under "U.S. PATENT DOCUMENTS", replace "1,879,117" with --1,879,177--.

Signed and Sealed this
Eighth Day of May, 2012

David J. Kappos

David J. Kappos
*Director of the United States Patent and Trademark Office*